US010568392B2

(12) United States Patent
Swaggart

(10) Patent No.: US 10,568,392 B2
(45) Date of Patent: Feb. 25, 2020

(54) APPARATUS FOR FASTENING STRAPS, METHOD TO FASTEN STRAPS

(71) Applicant: Matthew Swaggart, Tulsa, OK (US)

(72) Inventor: Matthew Swaggart, Tulsa, OK (US)

( * ) Notice: Subject to any disclaimer, the term of this patent is extended or adjusted under 35 U.S.C. 154(b) by 0 days.

(21) Appl. No.: 15/471,163

(22) Filed: Mar. 28, 2017

(65) Prior Publication Data

US 2018/0279723 A1 Oct. 4, 2018

(51) Int. Cl.
*A44B 11/22* (2006.01)

(52) U.S. Cl.
CPC ..... *A44B 11/22* (2013.01)

(58) Field of Classification Search
CPC ..... A44B 11/22
See application file for complete search history.

(56) References Cited

U.S. PATENT DOCUMENTS 268,781 A 12/1882 Conway
370,757 A 10/1887 Banks
374,177 A * 12/1887 Detrick ..... A44C 5/14 24/265 R
720,201 A * 2/1903 White ..... A44B 11/24 24/175
871,981 A * 11/1907 Blum ..... A44B 11/04 2/268
900,774 A * 10/1908 Pearl ..... A44B 11/22 24/176
970,184 A 9/1910 Conway
1,320,835 A * 11/1919 Braxton ..... F16G 3/00 24/176
1,603,911 A * 10/1926 Essman ..... A44B 11/00 2/245
1,913,413 A * 6/1933 Schaefer ..... A44B 11/04 24/186
1,934,951 A * 11/1933 Schaefer ..... A44B 11/04 24/186
2,084,412 A * 6/1937 Schaefer ..... A41F 15/00 24/186
2,129,872 A * 9/1938 Reiter ..... A44B 11/02 24/196
D125,083 S * 2/1941 Dickson ..... D11/218
2,419,662 A * 4/1947 Sutton ..... A44B 11/22 24/176
2,783,516 A * 3/1957 Stein ..... A44B 11/22 24/176
2,828,522 A * 4/1958 Stein ..... A44B 11/04 24/198

(Continued)

*Primary Examiner* — Robert Sandy
*Assistant Examiner* — David M Upchurch
(74) *Attorney, Agent, or Firm* — Cherskov Flaynik & Gurda, LLC

(57) ABSTRACT

Briefly, the invention provides a one-piece buckle having a protuberance extending in a first direction and at least a second protuberance extending in a second direction opposite the first direction. Also provided is a method for fastening two portions of strap having the steps of mating a protuberance on a buckle with a first set of coaxial holes in a first and second strap portion, wherein the protuberance extends in a first direction, and mating at least one protuberance with a second set of coaxial holes in the first and second strap portions, wherein the at least one protuberance extends in a second direction opposite the first direction.

13 Claims, 8 Drawing Sheets

(56) References Cited

U.S. PATENT DOCUMENTS

| | | | | | |
|---|---|---|---|---|---|
| 2,884,675 | A | * | 5/1959 | Sternschuss | A44B 11/22 24/163 FC |
| D303,456 | S | * | 9/1989 | Selisky | D11/218 |
| 5,127,136 | A | | 7/1992 | Magnus | |
| 5,452,498 | A | * | 9/1995 | Veach | A44B 11/22 24/164 |
| D411,485 | S | * | 6/1999 | Dreyfus | D11/218 |
| 6,830,166 | B1 | | 12/2004 | Laats et al. | |
| 8,429,798 | B1 | | 4/2013 | Paigen | |
| 9,301,578 | B2 | * | 4/2016 | Shinya | A44B 11/04 |
| 2013/0283501 | A1 | * | 10/2013 | Moritz | A41F 9/002 2/321 |

* cited by examiner

APPARATUS FOR FASTENING STRAPS, METHOD TO FASTEN STRAPS

BACKGROUND OF THE INVENTION

1. Field of the Invention

This invention relates to an apparatus for fastening straps, and more specifically, this invention relates to a device for fastening two straps together or fixing a single strap in a loop of desired size.

2. Background of the Invention

Many devices exist for fixing the position or loop-size of a strap. Buckles are an example of such devices. Buckles allow fixation of a strap, often using a movable or immovable barb extending through a hole in the strap.

Movable barb systems allow for facile creation of the loop and adjustment of loop size. Buckles with movable barbs have disadvantages, however. For example, through repeated use, the movable barb can often become loose and break free from the buckle. Further, as common buckles are more than one piece, manufacturing is more complicated than molding one piece fastening devices and involves casting and assembly of multiple pieces.

There are one-piece buckles or strap fastening devices. Such devices stem from the original design of the Conway buckle as described in U.S. Pat. No. 268,781. Such buckles are a single piece and secure a strap using a single barb and two retention loops. These buckles have disadvantages such as straps coming loose from the central barb. As the buckle provides no force keeping the strap and barb together, straps frequently come loose from these buckles.

To eliminate straps coming loose from one-piece buckles, state-of-the art buckles have added loops or moving-prong buckles to the original Conway design. These designs are overcomplicated and do not solve the real problem of a strap coming loose.

Thus, a need exists in the art for an apparatus for fastening straps. Ideally, the apparatus would be one-piece (i.e., static) so as to passively prevent straps from disengaging from the apparatus.

SUMMARY OF INVENTION

An object of the invention is to provide an apparatus for fastening one or more straps that overcomes disadvantages of the prior art.

Another object of the present invention is to provide an apparatus for simply and effectively fastening one or more straps. A feature of the invention is that it is one-piece and passive. An advantage of the apparatus is that it is robust and longer lasting than buckles or fastening devices having moving parts. A further advantage of the invention is that the apparatus can be manufactured via a single casting or molding step.

Yet another object of the invention is to provide a device for fastening straps that passively prevents straps from slipping off the device. A feature of the invention is providing at least one pair of opposing strap-engaging protuberances. An advantage is that the opposing protuberances provide opposing forces, preventing the strap from slipping off either protuberance.

Still yet another object of the invention is providing a single apparatus capable of fastening different straps. A feature of the invention is that the apparatus can be used to fasten two parallel straps, fix the size of a loop comprising a single strap, and fasten two perpendicular straps. An advantage of the invention is that it provides a simple, one-piece buckle that is useful for fastening straps in multiple configurations.

Briefly, the invention provides a buckle for joining two portions of a strap, the buckle comprising an elongated generally flat frame with a first lateral rib, a second lateral rib and a central rib positioned between the first and second lateral ribs so as to define a void between the first lateral rib and the central rib and a second void between the central lateral rib and the second lateral rib, wherein the void is adapted to reversibly receive the strap; a first protuberance extending in a first direction, the first protuberance supported on a surface of the central rib; and a second protuberance extending in a second direction, the second protuberance supported on a surface of either one of said first lateral rib and second lateral rib, wherein the first direction and the second direction are different.

Also provided is a method for fastening two portions of strap, the method comprising mating a first protuberance on a buckle with a first set of coaxial holes in a first and second strap portion, wherein the protuberance extends in a first direction; and mating at least one protuberance with a second set of coaxial holes in the first and second strap portions, wherein the at least one protuberance extends in a second direction opposite the first direction.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The present invention is a novel strap fastening system having at least two barbs, the two barbs extending in opposite directions. When in use, the two barbs apply force in opposite directions and aid in securing a strap or sections of strap to the system.

An embodiment of the invention is useful in fastening two lengths of strap together or fixing the loop size of a single length of strap. The invention can be used with straps of any material and can be scaled in size to be useful with straps of any length, width, and thickness.

Device Detail

Figure 1A:
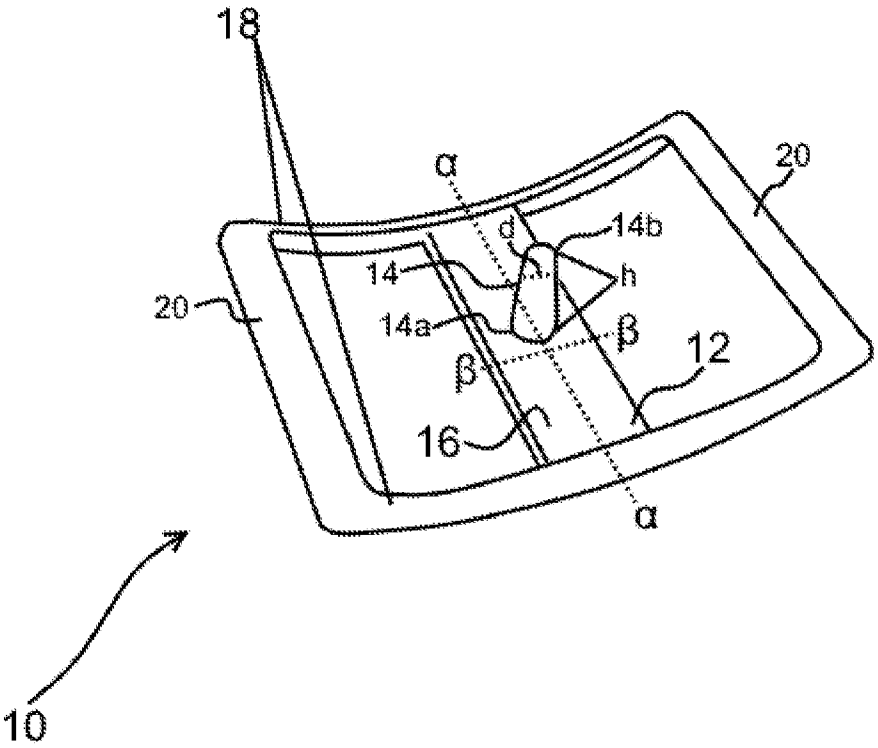
FIG. 1A is a perspective view of the medially (e.g., inwardly) facing side of an embodiment of the invention, in accordance with the features of the present invention.

An exemplary embodiment of the invented device is shown in FIGS. 1A and B and designated as numeral 10. The device 10 includes a central plate member 12. The central plate member 12 as shown in FIG. 1 is flat and rectangular, and extends in a first plane along a line α-α that is generally orthogonal to the longitudinal axis of the device.

In alternative embodiments, the central member plate may be any shape and may be curved, non-flat (e.g. convex or concave in topography). The device features at least one protuberance 14 extending from the medially facing surface 16 of the central plate member 12. The at least one protuberance 14 is located substantially in the center of the medially-facing surface 16 of the central plate member 12.

The at least one protuberance 14 may have any shape suitable for mating with a corresponding hole in a strap. As shown in FIGS. 1A and B, the protrusions 14 may be ovoid. Other suitable shapes are cylindrical, triangular, quadrilateral, polygonal, or irregular shaped. Further, the protrusion 14 has a height dimension h and a cross-sectional diameter d. As shown in FIGS. 1A and B, the protrusion 14 may narrow in diameter d between its first end 14*a* and second end 14*b*. In this embodiment, the relatively narrow second end 14*b* of the protrusion facilitates easy insertion of the protrusion into a corresponding hole in a strap, but also enables frictional engagement of the hole with the first end 14*a* of the protrusion, the first end being larger in diameter than the second end. This frictional engagement provides additional means for fastening the strap to that region of the buckle. In alternative embodiments, the cross-sectional diameter of the protrusion 14 is uniform throughout the height h of the protrusion.

Lateral aspects of a pair of retaining loops 18 are positioned in a second plane so as to extend above the first plane and therefore above a medially facing (e.g., facing the wearer) surface of the central plate member 12. As such, the medially facing surface of the buckle is concave in shape. In the embodiment depicted in FIG. 1A, the retaining loops 18 are integrally molded with, and spaced equally apart from the central plate member 12 along the central plate member's latitudinal axis β. The retaining loops 18 terminate in terminating members 20, said terminating members running parallel or substantially parallel to the longitudinal axis α of the central plate member 12, The terminating members 20 are therefore configured to reside on either side of the central plate member so as to defining the lateral boundaries of the buckle. So configured, the retaining loops and central plate member define two voids (element 21 in FIG. 1B) generally coplanar and adapted to reversibly receive longitudinally extending regions of a strap or belt.

Figure 1B:
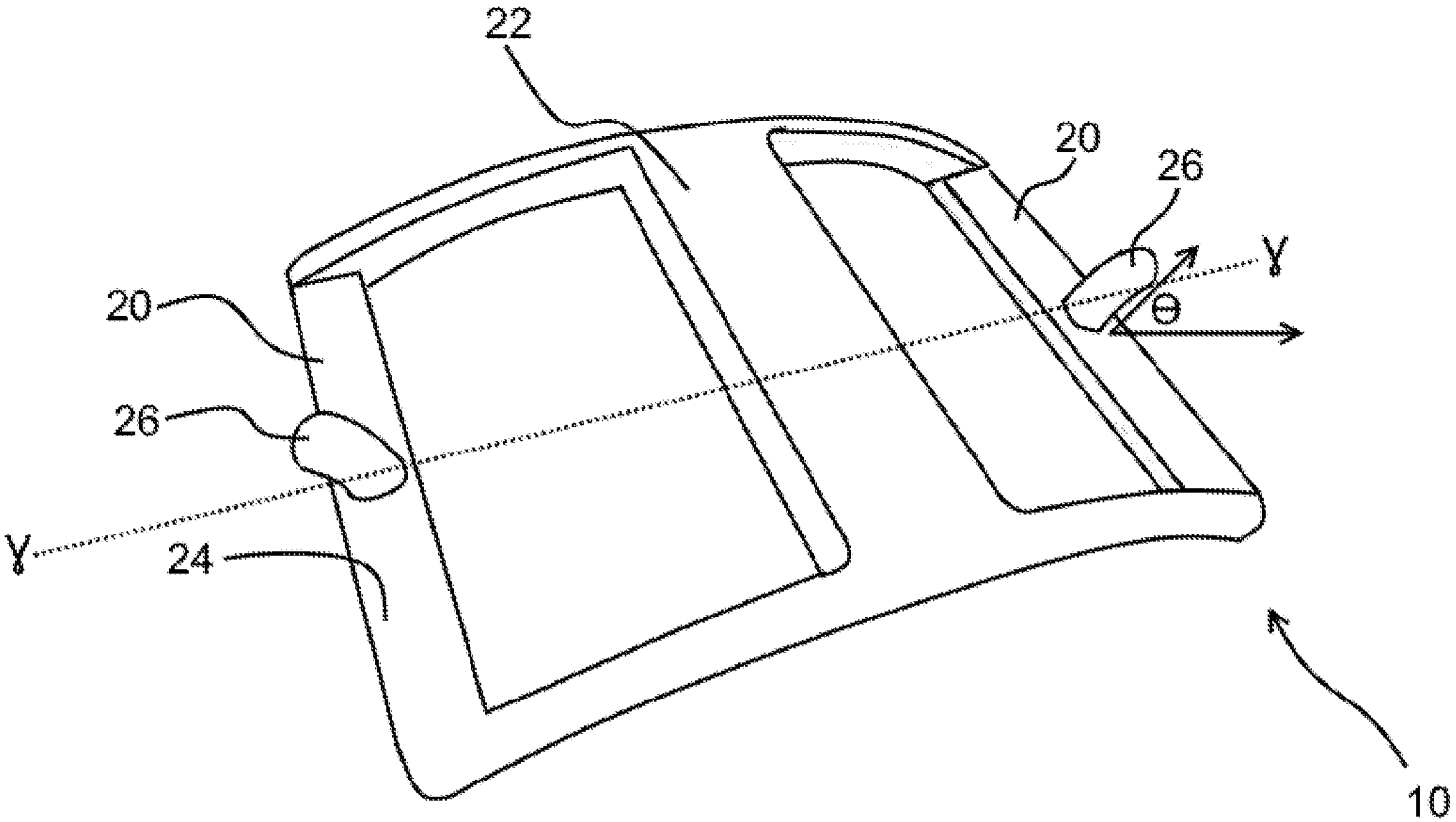
FIG. 1B is a perspective view of the laterally (e.g., outwardly) facing side of an embodiment of the invention, in accordance with the features of the present invention.

FIG. 1B shows the laterally (e.g., outwardly) facing side 22 of the device 10 shown in FIG. 1A. This side defines a convex topography. Viewing this side of the buckle, the terminating, members 20 of the retaining loops 18 reside in a third plane that is lower than the first plane in which the central plate member 12 resides, as described supra.

This outwardly facing side 22 of the device defines a corresponding laterally facing surface 24. A protuberance 26 extends outwardly from the laterally facing surface 24 at an angle Θ to the surface of between about 20 degrees and about 60 degrees. This protuberance is found on at least one of the terminating members 20. In an embodiment, only one of the terminating members 20 features a laterally extending protuberance 26. In the embodiment shown in FIG. 1B. Both terminating members 20 feature outwardly extending protuberances 26. In certain embodiments featuring two laterally extending protuberances 26, the protuberances are similarly angled and otherwise positioned with respect to the outwardly facing surfaces 24. For example, each protuberance may be angled at the same degree or slope relative to the surface 24 with a line defined by both protuberances overlaying the longitudinal axis γ-γ of the buckle.

In alternative embodiments, the laterally extending protuberances 26 are not situated in the same position with respect to their respective terminating members 20. In such embodiments, the laterally extending protuberances can be positioned to mate with irregularly placed holes in a strap to be fastened with the device 10.

In an embodiment of the invention, the laterally extending protuberances 26 are substantially identical to the protuberance 14 from the central plate 12 in FIG. 1A. As such, the laterally extending protuberances can be fabricated into any of the shapes and configurations referenced above for the protrusion 14 from the central plate 12. In an embodiment, the medially extending protuberance 14 of the central plate 12 and the laterally extending protuberances 26 are identical in shape and size. In other embodiments, the size and shapes of each protuberance 14, 26 vary such that all three protuberances of the system 10 are different. In other embodiments, both laterally extending protuberances are different than the medially extending protuberance, at least in their angle of attachment to their respective supporting substrate. For example, whereas the center protuberance is substantially orthogonal to its support substrate, the laterally disposed protuberances may be placed at angle to their respective supporting substrates that are different than 90 degrees. In still yet another embodiment, one of the laterally extending protuberances is identical to the medially extending protuberance with the remaining protuberance at a different shape or size.

As shown in FIG. 1B, laterally extending protuberances are curved. In this embodiment, the laterally extending protuberances curve away from the center of the device. Such a configuration prevents a mated hole on a strap from sliding off of the curved protuberance. In alternative embodiments, the laterally extending protuberances are straight as the medially extending protuberance is shown in FIG. 1A.

Figure 1C:
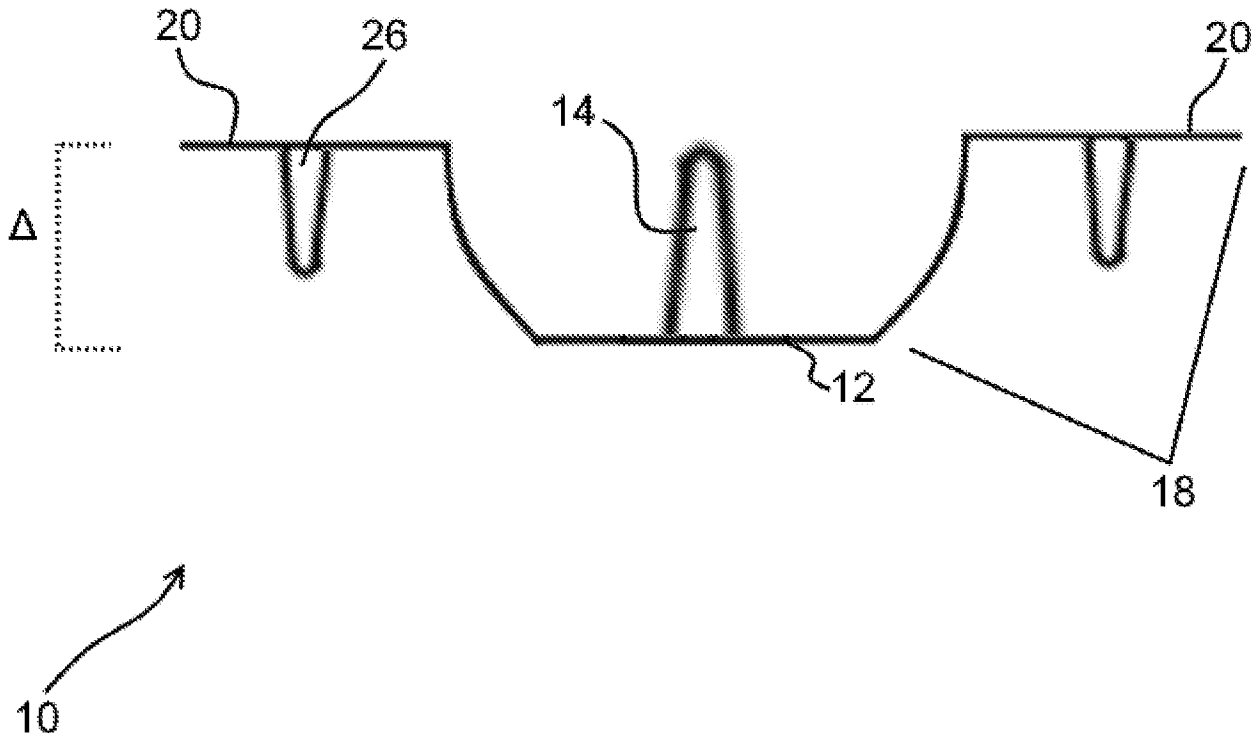
FIG. 1C is a side view of an embodiment of the invented device, in accordance with features of the present invention.

FIG. 1C shows a side view of the device 10. The retaining loops 18 can be fabricated to accommodate straps of any width or depth. As shown in FIG. 1C, the terminating members 20 are disposed above the medially facing (i.e., inward or toward the wearer) surface 16 of the central plate 12, wherein Δ represents the vertical distance between the central plate 12 and the terminating members 20. To accommodate thicker straps, the device 10 can be fabricated using larger Δ values. For thinner straps, the device 10 can be fabricated using smaller Δ values. Typically, a value of Δ is chosen so that the vertical distance between the central plate 12 and the terminating member 20 is just slightly larger than the combined thickness of two strap portions. Typically both retaining loops have the same Δ values. In alternative embodiments, one retaining loop has a bigger Δ value than the other. Given straps that are between about 0.0625 inches and 0.25 inches thick, Δ values are preferably between approximately 0.25 inches and approximately 1.5 inches, more preferably between approximately 0.125 inches and approximately 1 inch, typically between approximately 0.125 inches and approximately 0.75 inches.

Similarly, the device 10 can be fabricated to accommodate straps of any length and width. To do so, the device is fabricated so that its length along its longitudinal axis (coaxial with line β of FIG. 1A) is preferably between about 0.5 inches and about 6 inches, more preferably between about 0.75 inches and about 5 inches, and typically between about 1 inch and 4 inches. The width of the device (line α in FIG. 1A) is preferably between about 0.5 inches and about 4 inches, more preferably about 0.5 inches and about 3 inches, and typically about 0.5 inches and about 2.5 inches.

A salient feature of the present invention is that the device 10 is a single piece. Single piece construction allows for facile, one-step engineering of the instant invention. The device can be fabricated through casting in a mold with materials suitable to cast molding or by etching of materials suitable for etching. Exemplary materials include metals and elastomeric polymers. Exemplary metals include steel, iron, brass, aluminum, gold, silver, nickel, copper, and alloys thereof.

Strap Fastening Detail

Figure 2A:
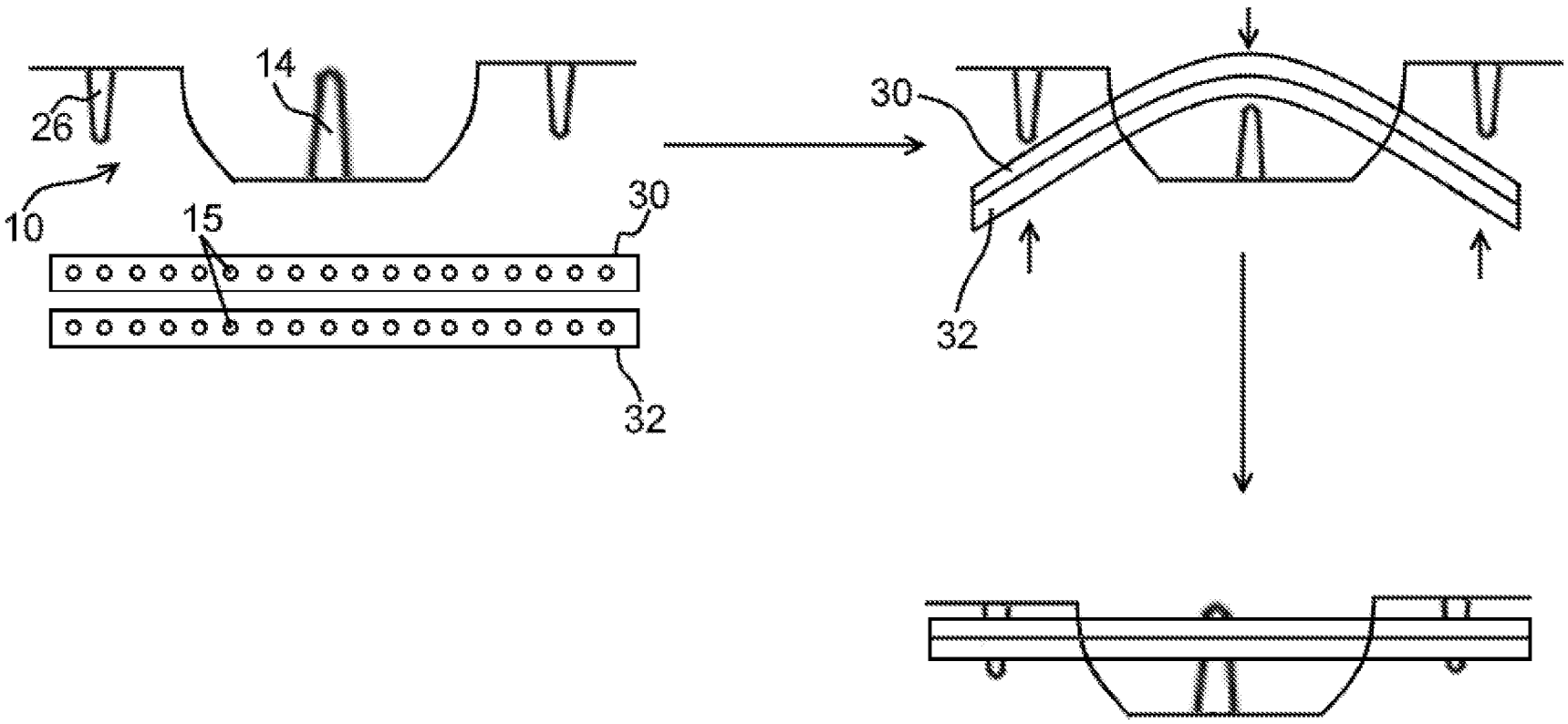
FIG. 2A is a schematic showing use of the present invention to fasten two strap portions, in accordance with the features of the present invention.

FIG. 2A depicts a schematic showing the invented device in use.

Generally, a user provides the device 10, a first strap portion 30, and a second strap portion 32. As shown in FIG. 2A, the strap portions feature holes 15 configured to receive the protuberances (laterally or medially extending) of the device 10. In use, both strap members 30 and 32 are reversibly inserted through both retaining loops of the device 10. Once the strap members 30, 32 are through both loops, a user causes the medially extending protuberance 14 of the central plate 12 into corresponding holes 15 in the first and second strap portions 30, 32. The user then inserts the laterally extending protuberances 26 from the terminating members 20 into corresponding holes 15 in the strap portions 30, 32.

FIG. 2A shows a method for using the present invention while using two straps simultaneously. Alternatively, a first strap portion can be inserted into the retaining loops and holes on the first strap portion mated with either the laterally extending protuberances or the central medially extending protuberance. The second strap portion would then be inserted so as to overlay the first strap and correspondingly mated with protuberances not mated with the first strap portion. A user would then continue to mate all protuberances with corresponding holes in strap portions until all protuberances are mated with both strap portions.

FIG. 2A demonstrates how two straps are fastened together: longitudinally extending regions of a first strap are overlaid by longitudinally extending regions of a second strap such that the two straps are in contact with each other over much of their lengths. In such a position, the longitudinal axes of the two straps also align and are parallel when fastened.

Alternatively, the two strap portions are opposite ends of the same strap. In this embodiment, the two ends of a single strap feature holes 15. The ends of the strap are inserted into the device and retaining loops as discussed above and shown in FIG. 2A. Using the invented device with a single strap having holes 15 at both ends provides a method for securing the strap in a loop of fixed size.

Figure 2B:
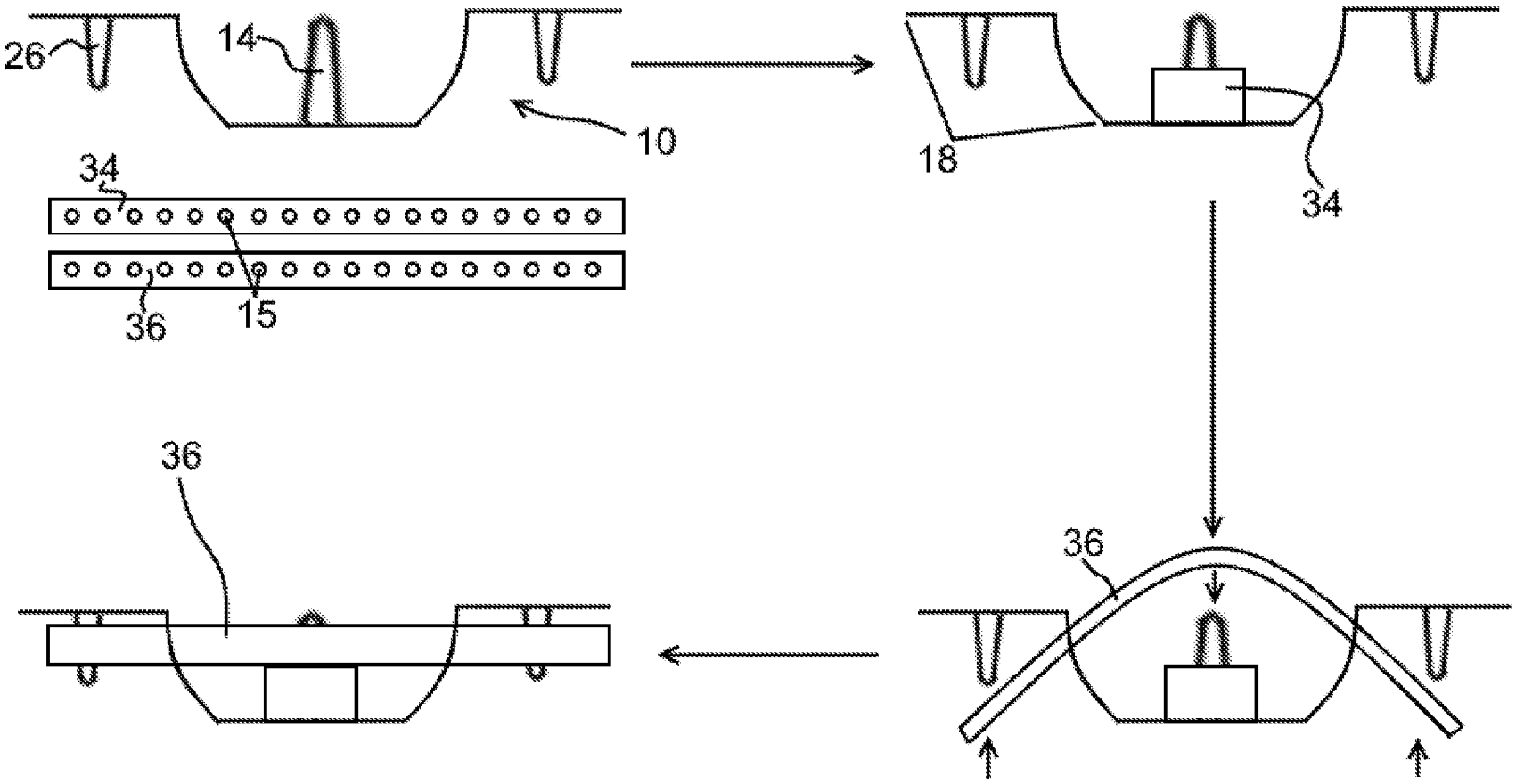
FIG. 2B is a schematic showing an alternative method of use of the present invention to fasten two strap portions, in accordance with the features of the present invention.
Figure 2C:
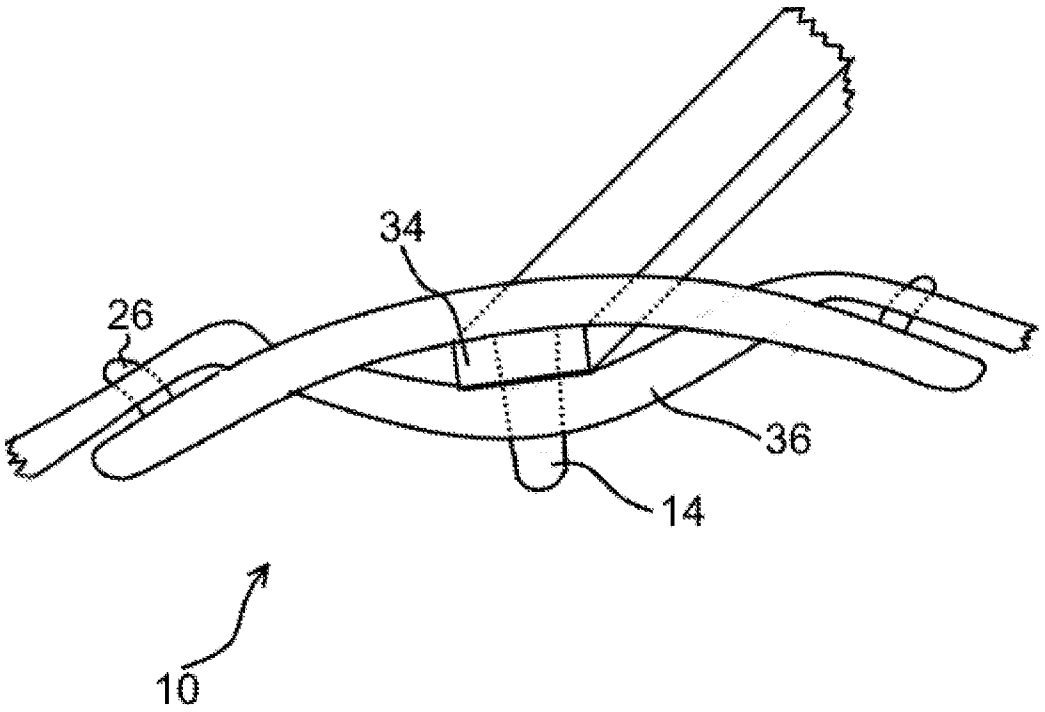
FIG. 2C is a perspective view of the invented system fastening perpendicular straps after the process depicted in FIG. 2B, in accordance with the features of the present invention.

In an alternative embodiment, the device 10 is used to fix two strap portions such that their longitudinal axes are perpendicular when fastened as depicted in FIG. 2B. In this embodiment, a hole 15 in a first strap portion 34 mates with the medially extending protuberance 14 of the central plate. A user then feeds a second portion of strap 36 through the retaining loops 18 of the device 10. In this configuration, the first strap portion 34 is perpendicular to and does not extend through the retaining loops 18. The user then mates corresponding holes 15 in the second strap portion 36 with the protuberances 14, 26 of the device. FIG. 2C shows a perspective view of the system 10 fastening the two strap portions 34, 36.

Figure 3A:
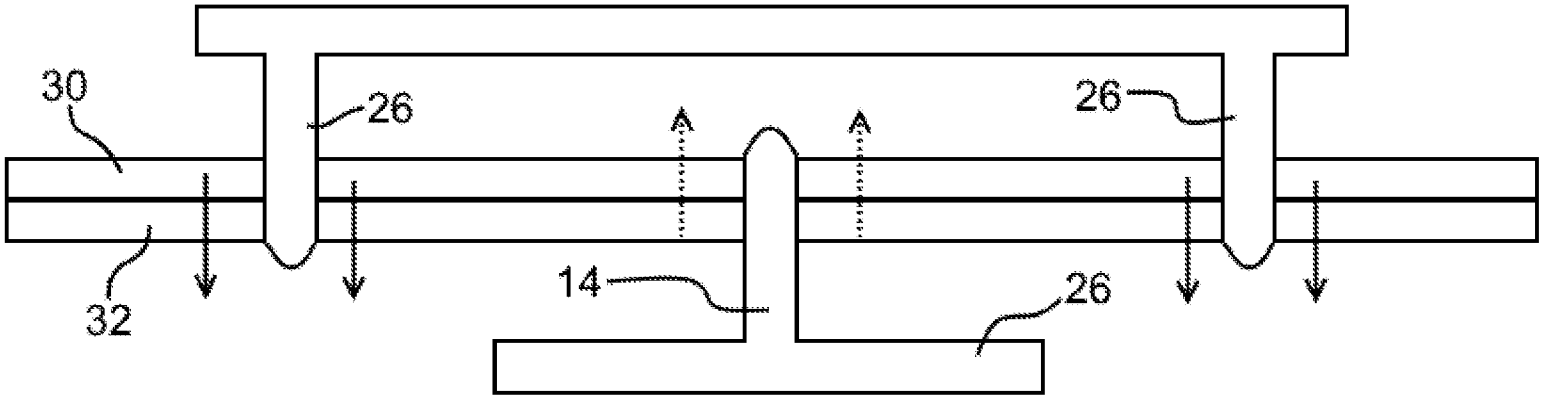
FIG. 3A is a cross-sectional view of the present invention in use, in accordance with the features of the present invention.

FIG. 3A depicts a cross sectional view of the device 10 when fastening two strap portions 30, 32. Looking to the figure, the medially extending protuberance 14 extends through the thickness of each strap portion 30, 32. In the embodiment depicted in FIG. 3A, the medially extending protuberance extends completely through the thicknesses of the two strap portions 30, 32, such that the second end 14*b* of the protuberance 14 protrudes through a hole 15 in the second strap length. Alternatively, the protuberances 14, 26 do not extend all the way through both straps. In such an embodiment, the protuberance(s) will extend at least through one strap but may only partially extend through the strap portion further along the height h of the protuberance.

A salient feature of the invention is its improved fastening ability over prior art, one-piece fastening devices. In prior art one-piece fastening devices, if the strap or straps being fastened come loose from the single protuberance, there is nothing preventing the straps from coming loose from the buckle. The present invention provides protuberances facing and penetrating strap portions so as to bias the ends different longitudinally extending regions of a single strap or a plurality of straps with opposing force. This provides additional means for assuring nesting of the straps within the buckles. As shown in FIG. 3A, the protuberance 14 on the central plate 12 extends medially through strap portions 30, 32 that are being fastened. Protuberances 26 on the terminating members 20, extend laterally through the strap portions 30, 32 that are being fastened.

As depicted in FIG. 3A, the instant device 10 automatically resists forces on one or both strap portions 30, 32 that would otherwise dislodge strap portions fixed only by one protuberance. For example, where a force (shown as dashed arrows) is imposed on the strap portions so as to urge those portions away from the medially extending protuberance 14 on the central plate 12, such a force only more firmly pushes the strap portions toward the laterally extending protuberances 26 and keep the strap portions 30, 32 fastened. Similarly, a force directed to dislodging the strap portions from the laterally extending protuberances 16 (shown as solid arrows) further secures the strap portions 30, 32 onto the medially extending protuberance.

Figure 3B:
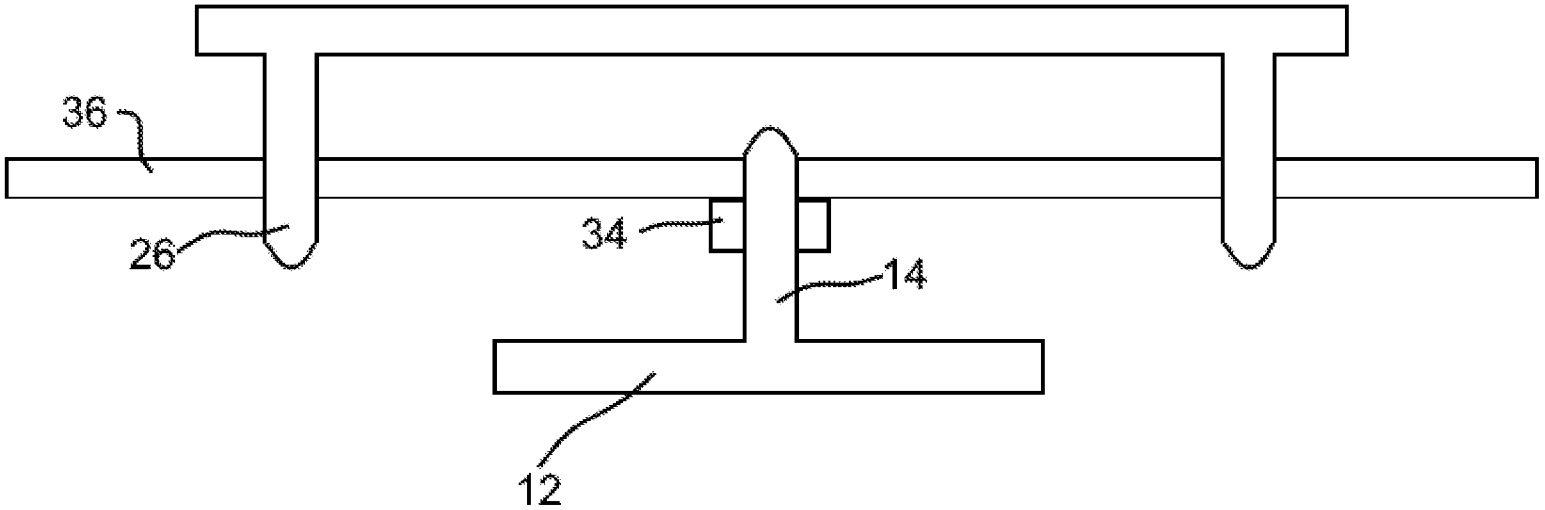
FIG. 3B is a cross-sectional view of an alternative method of use of the present invention, in accordance with the features of the present invention.

FIG. 3B depicts a cross sectional view of the device 10 when fastening two strap portions 34, 36, wherein the longitudinal axes of the strap portions are perpendicular.

Looking to the figure, the medially extending protuberance 16 is the only protuberance that extends through both strap portions 34, 36. The laterally extending protuberances 26 only contact and extend through the thickness of the second strap portion 32.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A system for joining two portions of a strap comprising:

a buckle comprising:

an elongated generally flat frame with a first lateral rib, a second lateral rib and a central rib positioned between the first and second lateral ribs so as to define a first void between the first lateral rib and the central rib and a second void between the central rib and the second lateral rib, wherein the first and second voids are adapted to reversibly receive the strap, wherein the central rib has a longitudinal axis that extends in a first plane, and wherein the first and second lateral ribs have longitudinal axes that extend in a second plane that is spaced above the first plane;

a first protuberance extending in a first direction, the first protuberance supported on a surface of the central rib;

a second protuberance extending from a surface of the first lateral rib, wherein the surface on the first lateral rib opposes the surface of the central rib; and said first lateral rib; and a third protuberance extending from a surface of the second lateral rib, wherein the surface of the second lateral rib opposes the surface of the central rib;

a first portion of strap having a series of holes defined within the strap, wherein the first protuberance of the buckle extends through a first hole in said first portion of strap; and a second portion of strap having a series of holes defined within the strap, wherein the first protuberance extends through a first hole in the second strap portion and the second protuberance extends through a second hole in the second strap portion.

2. The system for joining two portions of strap of claim 1 wherein the first and second strap portions extend through the voids between the first and second lateral ribs and the central rib, and wherein the second protuberance extends through a second hole in the first strap portion, and wherein the third protuberance extends through a third hole in the first strap portion and a third hole in the second strap portion.

3. The system for joining two portions of strap of claim 2 wherein the first strap portion is a first end of a strap and the second strap portion is a second end of the strap.

4. The system for joining two portions of strap of claim 2 wherein the first strap portion is a first strap and the second strap portion is a second strap.

5. The system for joining two portions of strap of claim 1 wherein the buckle is one piece.

6. The system for joining two portions of strap of claim 1 further comprising a first strap portion having a longitudinal axis parallel to the longitudinal axis of the central rib, wherein the first protuberance extending from the central rib extends through a first hole through the first strap portion; and a second strap portion extending through the voids between the lateral ribs and the central rib, wherein the protuberance of the central rib extends through a first hole through the second strap portion such that the two strap portions are prevented from moving relative to each other, and wherein the second and third protuberances extend through second and third holes through the second strap portion.

7. The system for joining two portions of strap of claim 1 wherein the buckle is made from a metal selected from the group consisting of steel, iron, brass, aluminum, gold, silver, nickel, copper, or combinations thereof.

8. The system for joining two portions of strap of claim 1 wherein the buckle is made from elastomeric polymer.

9. The system for joining two portions of strap of claim 1 wherein the second and third protuberances are curved and curve away from the central rib.

10. A system for joining two portions of strap comprising:

a buckle comprising:

an elongated generally flat frame with a first lateral rib, a second lateral rib and a central rib positioned between the first and second lateral ribs so as to define a first void between the first lateral rib and the central rib and a second void between the central rib and the second lateral rib, wherein the first and second voids are adapted to reversibly receive the strap, wherein the central rib has a longitudinal axis that extends in a first plane, and wherein the first and second lateral ribs have longitudinal axes that extend in a second plane that is spaced above the first plane;

a first protuberance extending in a first direction, the first protuberance supported on a surface of the central rib;

a second protuberance extending from a surface of the first lateral rib, wherein the surface on the first lateral rib opposes the surface of the central rib; and said first lateral rib; and a third protuberance extending from a surface of the second lateral rib, wherein the surface of the second lateral rib opposes the surface of the central rib;

wherein the system has first and second strap joining configurations, the first strap configuration comprising:

a first portion of strap extending through the voids between the first and second lateral ribs and the central rib, wherein the first portion of strap has a series of holes defined within the strap, wherein the first protuberance extends through a first whole in the first portion of strap, the second protuberance extends through a second hole in the first portion of strap, and the third protuberance extends through a third hole in the first portion of strap; and a second portion of strap extending through the voids between the first and second lateral ribs and the central rib, wherein the second portion of strap has a series of holes defined within the strap, wherein the first protuberance extends through a first whole in the second portion of strap, the second protuberance extends through a second hole in the second portion of strap, and the third protuberance extends through a third hole in the second portion of strap.

11. The system for joining two portions of strap of claim 10 wherein the system has a second strap joining configuration comprising:

a first strap portion having a longitudinal axis parallel to a longitudinal axis of the central rib, wherein the first protuberance extending from the central rib extends through a first hole through the first strap portion; and a second strap portion extending through the voids between the lateral ribs and the central rib, wherein the protuberance of the central rib extends through a first hole through the second strap portion such that the two strap portions are prevented from moving relative to each other, and wherein the second and third protuberances extend through second and third holes through the second strap portion.

12. A system for joining two portions of strap comprising:

a buckle comprising:

an elongated generally flat frame with a first lateral rib, a second lateral rib and a central rib positioned between the first and second lateral ribs so as to define a first void between the first lateral rib and the central rib and a second void between the central rib and the second lateral rib, wherein the first and second voids are adapted to reversibly receive the strap, wherein the central rib has a longitudinal axis that extends in a first plane, and wherein the first and second lateral ribs have longitudinal axes that extend in a second plane that is spaced above the first plane;

a first protuberance extending in a first direction, the first protuberance supported on a surface of the central rib;

a second protuberance extending from a surface of the first lateral rib, wherein the surface on the first lateral rib opposes the surface of the central rib; and said first lateral rib; and a third protuberance extending from a surface of the second lateral rib, wherein the surface of the second lateral rib opposes the surface of the central rib;

wherein the system has first and second strap joining configurations, the second strap configuration comprising:

a first strap portion having a longitudinal axis parallel to a longitudinal axis of the central rib, wherein the first protuberance extending from the central rib extends through a first hole through the first strap portion; and a second strap portion extending through the voids between the lateral ribs and the central rib, wherein the protuberance of the central rib extends through a first hole through the second strap portion such that the two strap portions are prevented from moving relative to each other, and wherein the second and third protuberances extend through second and third holes through the second strap portion.

13. The system for joining two portions of strap of claim 12 wherein the system has a first strap joining configuration comprising:

a first portion of strap extending through the voids between the first and second lateral ribs and the central rib, wherein the first portion of strap has a series of holes defined within the strap, wherein the first protuberance extends through a first whole in the first portion of strap, the second protuberance extends through a second hole in the first portion of strap, and the third protuberance extends through a third hole in the first portion of strap; and a second portion of strap extending through the voids between the first and second lateral ribs and the central rib, wherein the second portion of strap has a series of holes defined within the strap, wherein the first protuberance extends through a first whole in the second portion of strap, the second protuberance extends through a second hole in the second portion of strap, and the third protuberance extends through a third hole in the second portion of strap.

* * * * *